US005891325A

United States Patent [19]

Bearden et al.

[11] Patent Number: 5,891,325

[45] Date of Patent: Apr. 6, 1999

[54] PROCESS FOR REDUCING TOTAL ACID NUMBER OF CRUDE OIL

[75] Inventors: Roby Bearden, Baton Rouge, La.; Saul Charles Blum, Edison, N.J.; William Neergaard Olmstead, Murray Hill, N.J.; Winston Karl Robbins, New Providence, N.J.

[73] Assignee: Exxon Research and Engineering Co., Florham Park, N.J.

[21] Appl. No.: 132,295

[22] Filed: Aug. 11, 1998

[51] Int. Cl.[6] ..... C10G 17/00; C10G 19/02

[52] U.S. Cl. ..... 208/263; 208/283; 208/284; 208/285

[58] Field of Search ..... 208/263, 283, 208/284, 285

[56] References Cited

U.S. PATENT DOCUMENTS

| | | | |
|---|---|---|---|
| 1,236,230 | 8/1917 | Suter | 187/328 |
| 1,953,353 | 4/1934 | Lazar et al. | 208/263 |
| 2,770,580 | 11/1956 | Honeycutt et al. | 196/36 |
| 2,795,532 | 6/1957 | Honeycutt et al. | 196/36 |
| 2,921,023 | 1/1960 | Holm | 208/263 |
| 3,617,501 | 11/1971 | Eng et al. | 208/89 |
| 3,761,534 | 9/1973 | Sun et al. | 260/674 A |
| 3,806,437 | 4/1974 | Franse et al. | 204/190 |
| 3,847,774 | 11/1974 | Jarrell | 204/190 |
| 4,033,860 | 7/1977 | Carlson | 208/206 |
| 4,199,440 | 4/1980 | Verachtert | 208/230 |
| 4,300,995 | 11/1981 | Liotta | 208/8 |
| 5,011,579 | 4/1991 | Davis | 203/37 |

FOREIGN PATENT DOCUMENTS

| | | | |
|---|---|---|---|
| 612730 | 3/1961 | Canada . | |
| 9606899 | 7/1996 | WIPO | 45/50 |

OTHER PUBLICATIONS

Vladimir A. Kalichevsky and Kenneth A. Kobe, *Petroleum Refining with Chemicals*, Elsevier Publishing Co., 1956.

*Primary Examiner*—Glenn A. Caldarola
*Assistant Examiner*—Tam M. Nguyen
*Attorney, Agent, or Firm*—Estelle C. Bakun

[57] ABSTRACT

The instant invention is directed to a process for reducing organic acids in petroleum feeds containing organic acids comprising: (a) thermally treating a petroleum feed containing organic acids in a thermal reaction zone comprising a plurality of stages in series, at a temperature and pressure sufficient to decompose at least a portion of said organic acids while sweeping said plurality of stages with an inert gas, to produce a volatile organic acid containing hydrocarbon fraction and a non-volatile hydrocarbon fraction; (b) treating said volatile hydrocarbon fraction to neutralize at least a portion of said organic acids therein and to produce a treated volatile hydrocarbon fraction; (c) collecting said non-volatile hydrocarbon fraction from said thermal reaction zone; and (d) blending said treated volatile hydrocarbon fraction of step (b) with said collected non-volatile hydrocarbon fraction.

17 Claims, 1 Drawing Sheet

FIGURE
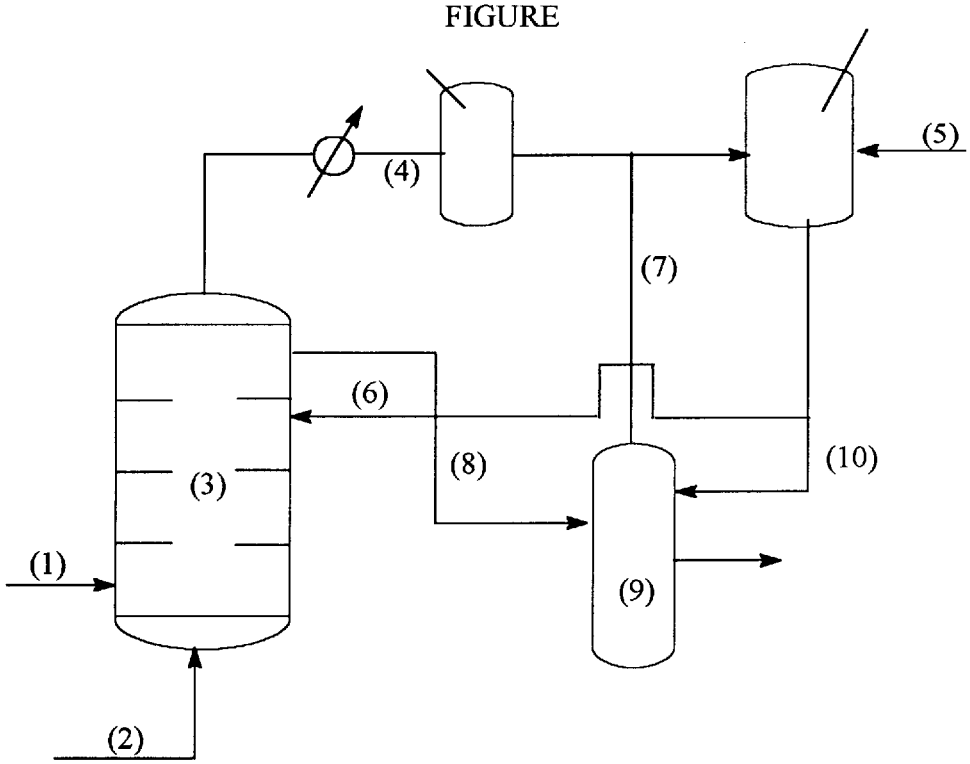

PROCESS FOR REDUCING TOTAL ACID NUMBER OF CRUDE OIL

FIELD OF THE INVENTION

The instant invention is directed to a process for reducing the Total Acid Number of crude oil.

BACKGROUND OF THE INVENTION

The present invention is directed to a method for reducing the Total Acid Number (TAN) of crude oils, a number that is based on the amount of organic acids, e.g, carboxylic acids, especially naphthenic acids, that are present in the oil.

BACKGROUND OF THE INVENTION

The presence of relatively high levels of petroleum acids, e.g., naphthenic acids, in crude oils or fractions thereof is a problem for petroleum refiners and more recently for producers as well. Essentially, these acids, which are found to a greater or lesser extent in virtually all crude oils, are corrosive, tend to cause equipment failures, and lead to high maintenance costs, more frequent turnarounds than would otherwise be necessary, reduce product quality, and cause environmental disposal problems.

A very significant amount of literature, both patents and publications, exists that deal with naphthenic acid removal by conversion or absorption. For example, aqueous material addition, absorption on zeolites, use of expensive corrosion resistant alloy materials in refinery or producer equipment and blending of crudes with high TAN with crudes of lower TAN.

Lazar, et al (U.S. Pat. No. 1,953,353) teaches naphthenic acid decomposition of topped crudes or distillates, effected at atmospheric pressure between 600° and 750° F. (315.6° to 398.9° C.). However, it only recognizes $CO_2$ as the sole gaseous non-hydrocarbon, naphthenic acid decomposition product and makes no provision for avoiding buildup of reaction inhibitors.

Additionally, U.S. Pat. No. 2,921,023 describes removal of naphthenic acids from heavy petroleum fractions by hydrogenation with a molybdenum oxide-on-silica/alumina catalyst.

WO 96/06899 describes a process for removing essentially naphthenic acids from a hydrocarbon oil. The process includes hydrogenation at 1 to 50 bar (100 to 5000 kPa) and at 100° to 300° C. (212° to 572° F.) of a crude that has not been previously distilled or from which a naphtha fraction has been distilled using a catalyst consisting of Ni—Mo or Co—Mo on an alumina carrier.

U.S. Pat. No. 3,617,501 describes an integrated process for refining whole crude but does not discuss TAN reduction.

British Patent 1,236,230 describes a process for the removal of naphthenic acids from petroleum distillate fractions by processing over supported hydrotreating catalysts without the addition of gaseous hydrogen. No mention is made of controlling water and carbon dioxide partial pressure.

Treatments with aqueous base have also been described (See for example U.S. Pat. Nos. 4,199,440; 4,300,995; 3,806,437; 3,847,774; 4,033,860; 5,011,579; and Kalichevsky and Kobe, *Petroleum Refining with Chemicals* (1956) Chapter 4.

U.S. Pat. Nos. 2,795,532 and 2,770,580 disclose processes in which heavy mineral oil fractions and petroleum vapors respectively are treated.

Thus, there remains a need for eliminating or at least substantially reducing petroleum acid concentration in crudes or fractions thereof that is low cost and refinery friendly. Such technology would be particularly suitable for crudes or fractions where the TAN value is about 2 or above. TAN, determined by ASTM method D-664, is measured as milligrams of KOH required to neutralize the organic acids contained in 1.0 gram of oil.

SUMMARY OF THE INVENTION

The instant invention is directed to a process for reducing organic acids in petroleum feeds containing organic acids comprising:

(a) thermally treating a petroleum feed containing organic acids in a thermal reaction zone comprising a plurality of stages in series, at a temperature and pressure sufficient to decompose at least a portion of said organic acids while sweeping said plurality of stages with an inert gas, to produce a volatile organic acid containing hydrocarbon fraction and a non-volatile hydrocarbon fraction; (b) treating said volatile hydrocarbon fraction to neutralize at least a portion of said organic acids therein and to produce a treated volatile hydrocarbon fraction; (c) collecting said non-volatile hydrocarbon fraction from said thermal reaction zone; and (d) blending said treated volatile hydrocarbon fraction of step (b) with said collected non-volatile hydrocarbon fraction.

As used herein, the plurality of reaction stages or zones includes both a plurality of reactors or a plurality of reaction zones within the same reactor. In the instant invention, it is understood that feed may be continuously introduced to the process and volatile hydrocarbon fractions formed.

TAN is defined as the weight in milligrams of base required to neutralize all acidic constituents in the oil. Typically, the organic acids being neutralized will be carboxylic acids, more specifically, naphthenic acids.

BRIEF DESCRIPTION OF THE FIGURE

The FIGURE is an example of one possible configuration for conducting the instant invention in the recycle mode. (1) is crude oil, (2) is fuel gas, (3) is a staged thermal reactor, (4) is a zone for recovery of acid-containing volatile liquid product, (5) is a reactor wherein at least a portion of the volatile liquid is treated with a basic salt of a Group IIA metal, (6) is a recycle line that carries treated volatile liquid to the reactor vessel, (7) is a line which returns volatile liquid to blend vessel (9) where it is mixed with non-volatile reactor oil (line 8) to become the treated crude product. Line 10 illustrates an embodiment of this invention wherein at least a portion of the stream treated with a basic salt of Group IIA metal is blended directly with non-volatile reactor oil.

DETAILED DESCRIPTION OF THE INVENTION

The instant invention neutralizes and destroys organic acids (e.g., carboxylic acids, more specifically, naphthenic acids) in petroleum feeds, including crude oils and crude oil fractions. For example, petroleum feeds such as whole crude oils (including heavy crudes) and fractions thereof such as vacuum gas oil fractions, topped crudes, atmospheric resids, vacuum resids, and vacuum gas oil.

The process of the instant invention includes a thermal treatment step conducted at temperatures sufficient to destroy organic acids. Preferably temperatures of at least about 400° F., more preferably at least about 600° F. The thermal treatment of step (a) comprises at least two thermal treatment reaction stages in series which can be within the same reactor or in separate reactors. The neutralized, or partially neutralized, volatile hydrocarbon fraction (referred to herein as the treated volatile hydrocarbon fraction) is reintroduced into a reaction stage other than the first reaction stage of step (a) when a recycle process is employed. Preferably the recycle stream enters the reactor at a stage when the decomposition of the acids contained in the non-volatile hydrocarbon fraction is essentially complete. As used herein, essentially complete means as much of the acid remaining in non-volatile hydrocarbon fraction decomposable by the thermal treatment has been decomposed. Preferably, the recycle stream is introduced at a stage where the concentration of acid in the non-volatile fraction, expressed as Total Acid Number (TAN), is less than about 1.0, and preferably below about 0.5. In the instant invention, fresh feed may be continuously introduced into the process and a volatile hydrocarbon fraction containing organic acids produced therefrom.

The inert gas sweep utilized during the thermal treatments of step (a) serves to sweep away acid decomposition inhibitors formed during acid decomposition. Principally, water will be swept away along with carbon dioxide.

A pre-flash to remove any bulk water that is present in the feed (disclosed in copending application U.S. Ser. No. 920,549), is likewise preferential. As much water as can be removed will preferably be removed.

Typically, thermal treatment or upgrading processes to reduce TAN are run at temperatures from about 400° to about 800° F. (about 204.44° to about 426.67° C.), more preferably about 450° to about 750° F. (about 232.22° to about 398.89° C.), and most preferably about 500° to about 725° F. (about 260.00° to about 385° C.). Pressures range from about atmospheric to about 1000 psig (about atmospheric to 6996.33 kPa), preferably about 15 to about 500 psig (about 204.75 to about 3548.83 kPa), and most preferably about 30 to about 300 psig (about 308.18 to about 2169.83 kPa). Conditions are chosen such that the TAN level of the non-volatile hydrocarbon fraction is below about 1.0, preferably below about 0.5

Though, the above conditions are typical of the art, other conditions for thermal treatment which produce a volatilized stream containing organic acids, would be suitable in the instant invention.

The inert gas sweep, or purge may comprise most any dry gas that will not react with oil. Thus as used herein, inert means those gases that will not react with, or alter the petroleum feed to any detectable level. Suitable examples include methane, fuel gas and nitrogen. Sweep rate in the reactor is adjusted to maintain the partial pressure of acid decomposition inhibitors (e.g., water and carbon dioxide) to a value below about 25 psia, preferably below about 10 psia, and most preferably, below about 2 psia. In general, the sweep gas rate will fall in the range of about 50 to 1000 standard cubic feet per barrel (SCF/Bbl.).

The thermal treating reactor operates at 400°–800° F., preferably 450° to 750° F. and most preferably from 500° to 725° F. Pressure is maintained below about 300 psig, preferably below 150 psig, and most preferably below 50 psig. Reaction time required to destroy the acids varies inversely with temperature, with longer times required at lower temperatures. Within the preferred temperature range of 700° to 750° F., reaction time will range from about 30 minutes to 120 minutes. Conditions are chosen such that the TAN level of the non-volatile hydrocarbon fraction is below about 1.0, preferably below about 0.5.

In the course of the thermal treating reaction a volatile hydrocarbon fraction is removed from the thermal reaction zone as gaseous effluent. The exact amount depends on feed type and reaction conditions. For certain heavy crudes the amount of volatile hydrocarbon fraction recovered amounts from about 5 to 25% of the crude that is fed to the reactor. Such streams typically contain low molecular weight volatile acids and the TAN of such streams can range from 1 to 4 or more.

Following thermal treatment of the petroleum feeds, the volatile hydrocarbon fraction is treated to reduce at least a portion of the organic acids contained therein. Such treatment includes contacting the volatile fraction with a basic salt. The basic salts which can be utilized herein are any of the basic salts known to the skilled artisan capable of neutralizing organic acids, particularly naphthenic acids. Preferably, basic salts of Group IA and Group IIA of the periodic table (See Basic Inorganic Chemistry, Cotton & Wilkinson, 1976) will be utilized. Preferably, the basic salt will be an oxide, hydroxide, hydroxide hydrate, or carbonate. Preferably the Group IIA salts will be used and most preferably salts of calcium or magnesium, even more preferably a calcium salt. For example, suitable salts include $CaO$, $Ca(OH)_2$, $CaCO_3$, $MgO$, $Mg(OH)_2$, $MgCO_3$ and mixtures thereof.

Applicants believe that treatment with the basic salts converts at least a portion of the volatile organic acids to the corresponding organic acid salts (in the volatile hydrocarbon fraction). Such materials can be recovered by conventional means and used as a source of, e.g., naphthenic acids for commercial sales.

The neutralization with the basic salts can be conducted by means known to those skilled in the art. For example, the methods set forth in WO97/08270, WO97/08275, and WO97/08271 herein incorporated by reference, may be used. Moreover, the volatilized hydrocarbon fraction of the petroleum feed may merely be passed over a bed of the basic salt to effect the degree of neutralization desired.

The contacting with the basic salt is typically carried out at either ambient temperature or at an elevated temperature sufficient to reflux the solution. Typically, this range is up to 200° C., with narrower ranges suitably from about 20° C. to 200° C., preferably 50° C. to 200° C., more preferably 75° C. to 150° C. When recycling, the neutralization should preferably be conducted at the highest possible temperature consistent with the process design to avoid the necessity for heating the neutralized volatile hydrocarbon fraction upon recycle to the reactor.

The basic salt, hydroxides, oxides, carbonates and hydroxide hydrates may be purchased commercially or synthesized using known procedures. In solid form, they may be in the form of a powder or a composite, sized particle or supported on a refractory (ceramic) matrix.

Reaction times depend on the temperature and nature of the petroleum feed to be treated, its acid content and the amount and type of basic salt added. Typically, the neutralization may be carried out for from less than about 1 hour to about 20 hours to produce a product having a decrease in corrosivity and acid content. The treated volatile hydrocarbon fraction contains naphthenate salts of the corresponding Group IA or IIA metal oxide, hydroxide, carbonate or hydroxide hydrate used in treatment. The conditions are readily determinable by the skilled artisan.

The reactor system for the thermal treating (step (a) of the process) is designed to provide liquid residence time at the chosen temperature adequate to achieve the desired conversion and achieve rapid mass transfer to remove inhibiting products of the acid decomposition reaction, i.e., water and carbon dioxide. Suitable reactors comprise two or more stages and may be, for example, of one of the following designs; bubble rise column, mechanically stirred bubble rise column and trickle bed, etc.

Recycle of the treated volatile hydrocarbon fraction has the added benefit of lowering the requirement for stripping gas in the thermal reactor. Additionally, the basic salts remaining in the crude can act as inhibitors against corrosion. Likewise, recycling serves to reduce the acidic content of the volatile hydrocarbon fraction of step (a) since neutralized acids in the recycled treated volatile hydrocarbon fraction are at least partially destroyed when introduced, via recycle, into the thermal reaction zone. Thus, the total volatile hydrocarbon fraction produced from the recycle process will comprise the volatile hydrocarbon fraction from fresh feed plus the recycled treated volatile hydrocarbon fraction.

In carrying out the instant invention using recycle, it is understood that petroleum feed is being introduced to the thermal reaction step (a) producing a volatile-hydrocarbon fraction. Thus, the total volatile hydrocarbon fraction produced upon completion of the recycle process, will be that from the fresh feed plus that amount of the recycled treated volatile hydrocarbon fraction. Following the last recycle, the volatile hydrocarbon fraction blended with the non-volatile hydrocarbon fraction will comprise the recycled treated volatile hydrocarbon fractions and any newly produced volatile hydrocarbon fractions from fresh petroleum feed introduced during the recycle. One skilled in the art will recognize that the number of recycles will be dependent upon the capacity of the thermal reactor being utilized and the TAN desired for the blended product.

In the practice of this invention the volatile hydrocarbon fraction is treated with the basic salt to neutralize at least a portion of the acids contained therein. The volatile hydrocarbon fraction is contacted with the basic salt in a mixing zone that operates in a range of 150° to 300° F. under autogenous pressure for a time sufficient to complete the reaction between the basic salt and the organic acid. Suitably a small amount of water, from 0.25 to 1.0 wt % based upon the weight of volatile liquid, is included in the mixing zone to facilitate the reaction.

In a preferred embodiment, a sufficient amount of basic salt is added to the volatile hydrocarbon fraction to completely neutralize the acid, and the entire treated stream is recycled to the reactor.

Referring to the FIGURE, the volume ratio of the neutralized volatile hydrocarbon stream (line 6) to the volatile liquid stream that is withdrawn for blending (line 7) is at least 1:1 and can range to 3:1 or higher. The higher the ratio, the lower the TAN of the volatile hydrocarbon fraction withdrawn from the process via line 7.

In another embodiment of the process, the treated volatile hydrocarbon fraction emerging from vessel 5 (post basic salt contact) is not recycled, but is fed directly to blend vessel 9. The basic salt so added acts as a buffer to mitigate the corrosive effects of any residual acids.

In still another embodiment of the process, the treated volatile hydrocarbon fraction emerging from vessel 5 (post basic salt contact) is not recycled to the reactor 3, but is fed to a separate thermal treating zone from step (a), e.g., a flash distillation zone (not shown) wherein the neutralized acid component of the stream is at least partially destroyed. The resultant treated volatile hydrocarbon fraction (with lower TAN) is then fed to blend vessel 9 or recycled to step (a). One skilled in the art can readily determine reaction conditions for such a step. Indeed, a time and temperature sufficient to destroy at least a portion of the neutralized acids would be selected.

In the recycle mode of the instant invention, the volatile hydrocarbon fraction emerging from the thermal treatment step (a) may be blended with the non-volatile hydrocarbon fraction without performing a final contacting step with basic salt. In such a case, the volatile hydrocarbon fraction (comprising both treated volatile hydrocarbon fractions and newly formed volatile hydrocarbon fraction originating from fresh feed) would be blended with the non-volatile hydrocarbon fraction via line (7). Alternatively, a final treatment of the volatile fraction can be conducted prior to blending.

The following Examples illustrate the invention but are not meant to be limiting in any way.

EXAMPLE #1 (COMPARATIVE)

This experiment was carried out in a 300 cc stirred autoclave reactor. The reactor was operated in batch mode with respect to the crude that was charged. Argon was flowed through the reactor to keep the combined partial pressures of water and carbon dioxide (acid decomposition gases that can inhibit acid decomposition) to less than 1.0 psia.

The reactor was charged with 100 g. of a Venezuelan extra heavy oil that had a TAN of 3.0, flushed with argon and then heated with stirring to a temperature of 725° F. Argon was flowed through the reactor at 0.14 liters per minute at a pressure of 30 psig, which was maintained by a back-pressure regulator. After a stirred reaction period at 725° F. the reactor was cooled and discharged. There were recovered 83.8 g. of reactor oil and 14.21 g. of a volatile hydrocarbon liquid that was removed from a cold trap downstream of the reactor. TAN assays on the reactor oil and volatile liquid were, respectively, 0.05 and 1.42.

The experiment was repeated several times to obtain volatile liquid product for subsequent recycle experiments.

EXAMPLE #2 (COMPARATIVE)

The experiment of Example #1 was repeated except that 12 g. of volatile liquid from Example #1 was charged to the autoclave along with 100 g. of fresh feed.

There were recovered 85.7 g. of reactor oil and 24.21 g. of volatile liquid. TAN assays on the reactor oil and volatile liquid were, respectively, 0.06 and 1.49.

This Example illustrates that recycle of volatile liquid without treatment with a basic salt does not result in any reduction in the TAN content of the volatile liquid product.

EXAMPLE #3

A calcium hydroxide treated volatile liquid was prepared in the following manner. To a 50 cc round-bottom flask equipped with stirrer and condenser there was charged 21 g. of volatile liquid (TAN 1.42) prepared according to Example #1, along with 0.036 g of calcium hydroxide powder and 0.13 g of deionized water. The flask was then heated with stirring at 200° F. for a period of 5 hours. The flask was cooled and the treated volatile liquid was decanted and stored for further use.

The experiment of Example #1 was repeated except that 9.45 g. of the calcium hydroxide treated volatile oil was charged along with 100 g. of fresh feed.

There were recovered 85.65 g. of reactor oil and 22.2 g of volatile liquid product. TAN assays on the reactor oil and volatile liquid were, respectively, 0.04 and 1.62.

This Example illustrates that recycle of calcium treated volatile product does not have a beneficial effect when the recycle stream is added to fresh feed or to the first stage of the thermal reactor, e.g., adding to stage 1 of a multi stage reactor.

EXAMPLE #4

Example #3 was repeated except that the calcium treated volatile liquid was not added to the fresh feed. Instead, the reactor was charged initially with 100 g of fresh feed. After a 34 minute stirred contact at 725° F., the reactor was cooled to 150° F. and 8.85 g. of calcium treated volatile liquid was added. The reactor was then heated to 725° F. for an additional 30 minute contact.

There were recovered 87.6 g. of reactor oil and 19.1 g. of volatile liquid product. TAN assays on the reactor oil and volatile liquid products were, respectively, 0.02 and 1.18.

This Example illustrates that recycle of a calcium treated volatile liquid can effectively reduce TAN of the volatile liquid provided that treated liquid is recycled to the reactor after fresh feed has undergone some degree of reaction, i.e., the treated volatile liquid is recycled to a second or third stage, etc.

EXAMPLE #5

A sample of 70 g. of volatile liquid (TAN=1) obtained from the thermal treatment of a Venezuelan heavy oil was charged to a round bottom flask along with 0.42 g. of deionized water and 0.07 g. of calcium hydroxide powder. The mixture was then heated and stirred at 200° F. for a period of 5 hours under an atmosphere of nitrogen. The resultant calcium treated oil was then placed in an autoclave and heated to 725° F. while sweeping with Argon at a rate of 0.05 liters per minute. At the end of a 30 minute period at 725° F., 61.14 g. of volatile liquid had distilled from the autoclave and 6.07 g. of volatile liquid still remained. TAN assays showed that the oil remaining in the autoclave had a TAN of 0.1, whereas the volatile oil had a TAN of 0.39.

This Example illustrates that the TAN content of a volatile oil can be reduced by treating said oil with a basic calcium salt and then distilling.

What is claimed is:

1. A process for reducing organic acids in petroleum feeds containing organic acids comprising:

(a) thermally treating a petroleum feed containing organic acids in a thermal reaction zone comprising a plurality of stages in series, at a temperature and pressure sufficient to decompose at least a portion of said organic acids while sweeping said plurality of stages with an inert gas, to produce a volatile organic acid containing hydrocarbon fraction and a non-volatile hydrocarbon fraction; (b) treating said volatile hydrocarbon fraction to neutralize at least a portion of said organic acids therein and to produce a treated volatile hydrocarbon fraction; (c) collecting said non-volatile hydrocarbon fraction from said thermal reaction zone; and (d) blending said treated volatile hydrocarbon fraction of step (b) with said collected non-volatile hydrocarbon fraction.

2. The process of claim 1 wherein said treatment step (b) comprises contacting said volatile hydrocarbon fraction with a basic salt of a metal selected from the group consisting of metals of Group IA, Group IIA, and mixtures thereof at a temperature and for a time sufficient to neutralize at least a portion of said organic acids.

3. The process of claim 2 further comprising thermally treating said volatile hydrocarbon stream at a temperature and for a time sufficient to destroy at least a portion of said neutralized organic acids.

4. The process of claim 1 further comprising recycling at least a portion of said treated volatile hydrocarbon fraction to a stage other than the first stage of said plurality of stages of step (a).

5. The process of claim 1 wherein said thermal treatment temperature of step (a) is at least about 400° F.

6. The process of claim 1 wherein said petroleum feed undergoes a preflash step to remove bulk water.

7. The process of claim 1 wherein said inert gas sweep maintains a partial pressure of acid decomposition products in the reactor of below about 25 psia.

8. The process of claim 1 wherein said inert gas sweep has a sweep rate in the range of about 50 to about 1000 SCF/Bbl.

9. The process of claim 1 wherein said temperature and pressure are chosen such that the non-volatile hydrocarbon fraction has a TAN of below about 1.0 following said thermal treatment of step (a).

10. The process of claim 2 wherein said basic salt is selected from the group consisting of hydroxides oxides, carbonates, hydroxide hydrates and mixtures thereof.

11. The process of claim 2 wherein said basic salt is a Group IIA metal salt.

12. The process of claim 11 wherein said basic salt is a calcium or magnesium salt.

13. The process of claim 12 wherein said basic salt is a calcium salt.

14. The process of claim 12 wherein said basic salt is selected from the group consisting of CaO, $Ca(OH)_2$, $CaCO_3$, MgO, $Mg(OH)_2$, $MgCO_3$ and mixtures thereof.

15. The process of claim 2 wherein said treatment is conducted in the presence of about 0.25 to about 1.0 wt % water.

16. The process of claim 1 wherein said stage other than said first stage of said plurality of stages (i) is a stage where the TAN of said non-volatile hydrocarbon fraction is less than about 1.0.

17. The process according to claim 4 where the ratio of neutralized volatile hydrocarbon fraction recycled, to the volatile hydrocarbon fraction entering step (c) ranges from about 1:1 to 3:1 or higher.

* * * * *